United States Patent [19]

Fish

[11] 4,027,558

[45] June 7, 1977

[54] RATCHET-TYPE TORQUE WRENCHES WITH EXTENDED TORQUE RANGE

[76] Inventor: Herbert L. Fish, 6525 Kerns Road, Falls Church, Va. 22044

[22] Filed: June 18, 1975

[21] Appl. No.: 587,899

[52] U.S. Cl. ..... 81/52.4 R; 81/58.2; 81/185

[51] Int. Cl.[2] ..... B25D 23/142

[58] Field of Search ..... 81/52.4 R, 58.2, 185, 81/177 G, 177 R

[56] References Cited

UNITED STATES PATENTS

| | | | |
|---|---|---|---|
| 905,070 | 11/1908 | Heck | 81/185 |
| 2,337,368 | 12/1943 | Bohler | 81/185 |
| 2,578,687 | 12/1951 | Fish | 81/58.2 |
| 2,962,918 | 12/1960 | Van Hoose | 81/52.4 R |
| 2,996,940 | 8/1961 | Van Hoose | 81/52.4 R |
| 3,175,434 | 3/1965 | Bergquist | 81/58.2 |

*Primary Examiner*—James L. Jones, Jr.
*Attorney, Agent, or Firm*—Shapiro and Shapiro

[57] ABSTRACT

Ratchet-type wrench heads employ drive adapters in conjunction with multiple torque wrench handles to provide wider ranges of torque ratings with each head.

1 Claim, 5 Drawing Figures

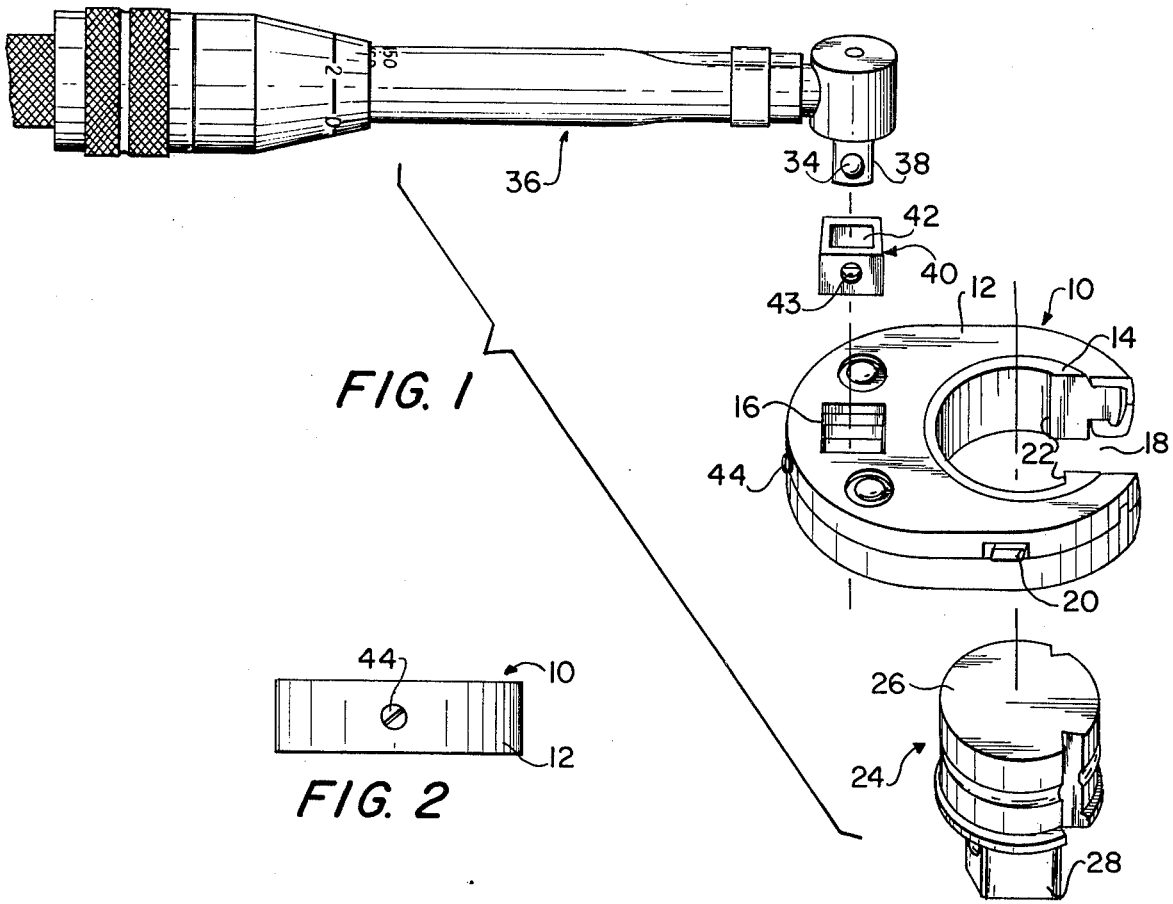
FIG. 1
FIG. 2
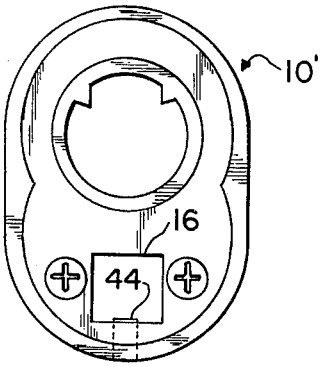
FIG. 3

RATCHET-TYPE TORQUE WRENCHES WITH EXTENDED TORQUE RANGE

BACKGROUND OF THE INVENTION

This invention is concerned with ratchet-type torque wrenches and more particularly with TAC pattern wrenches such as those covered by Federal Specification GGG-W-646 that have been available in the military supply system for years. TAC pattern wrench heads are available in many sizes and types but, in general, are characterized by a flat, elongated body with an annular ratchet wheel at one end for driving a socket, for example, and with a square drive opening at the other end for receiving the drive stud of a detachable handle. Different types of handles may be used with the same wrench heads, but the size of the square drive opening limits the choice of handles that can drive a given wrench head.

TAC pattern wrench heads have been found to be ideally suited for use with torque handles in tight quarters, the open-end head type being especially usefor for torqueing tube fittings and the like. Originally, the torque ratings of the wrench heads and sockets were established in conjunction with bar deflection or dial type torque handles. The wrench heads and the sockets were made stronger than the highest torque value required for the mating torque hndles, because more torque may be required to break loose a fitting than to tighten it to a particular torque value. Nevertheless, the torqueing capabilities of the wrench heads and sockets were fairly well matched to the torque ratings of the mating torque handles. In recent years micrometer type torque handles have largely supplanted the bar deflection type, because they can be used in tight places where the bar deflection type cannot be used. However, because of the reduced torqueing capabilities of micrometer type handles, compared to a bar deflection handle of the same drive size, the torqueing capabilities of available TAC pattern wrench heads and sockets have not been employed to maximum advantage. For example, a TAC pattern wrench head with ¼ inch square drive previously useful to a maximum torque value of 500 in.-lbs. can only be used for torqueing applications up to 150 in.-lbs. when driven by a ¼ inch square drive micrometer type torque handle having a maximum torque rating of 150 in.-lbs. TAC pattern wrench heads with a ⅜ inch square drive previously useful to a maximum torque rating of 1200 in.-lbs. can only be used up to 750 in.-lbs., because the ⅜ inch square drive micrometer type torque handle has a maximum rating of 750 in.-lbs. Similar limitations are placed upon other TAC pattern wrench heads in torqueing applications.

Because TAC pattern wrenches have become standardized over a period of years, fundamental re-design of the wrench heads and/or the handles to permit full utilization of the torque ratings of the wrench heads and sockets in torqueing applications would render obsolete the thousands of wrenches now in service. A different solution to the problem was required.

BRIEF DESCRIPTION OF THE INVENTION

It is accordingly an object of the present invention to provide a solution to the foregoing problem which does not require fundamental re-design of the TAC pattern wrench heads or the handles used therewith and which in no way detracts from the admirable qualities of TAC pattern wrenches, such as the ability to provide an extremely low, almost planar profile that permits the wrenches to be used in very tight quarters.

Briefly stated, in accordance with a preferred embodiment of the invention, the square drive opening of the TAC pattern wrench head is enlarged, so that, for example, a wrench head which previously accepted a ¼ inch drive stud of a wrench handle can now accommodate a ⅜ inch drive stud. This permits the use of micrometer type torque handles with a larger drive stud and with a higher torque rating commensurate with the maximum rating of the wrench head itself. Then, to permit the utilization of torque handles (as well as other handles) having a drive stud fitting the original drive opening of the wrench head, an adapter sleeve is provided, the sleeve being detachably mounted in the drive opening to reduce the opening to its original size. The ball detent of the handle drive studs is accommodated by an appropriate recess in the adapter sleeve. By this arrangement, much greater versatility, particularly with respect to the useful torque range, is achieved without in any way impairing the usual advantages of the TAC pattern wrenches.

BRIEF DESCRIPTION OF THE DRAWINGS

The invention will be further described in conjunction with the accompanying drawings, which illustrate preferred and exemplary embodiments, and wherein:

FIG. 1 is an exploded perspective view of a typical torque wrench assembly in accordance with the invention;

FIG. 2 is an end view of the wrench head of FIG. 1;

FIG. 3 is a plan view of a modification;

Figures 4, 5:
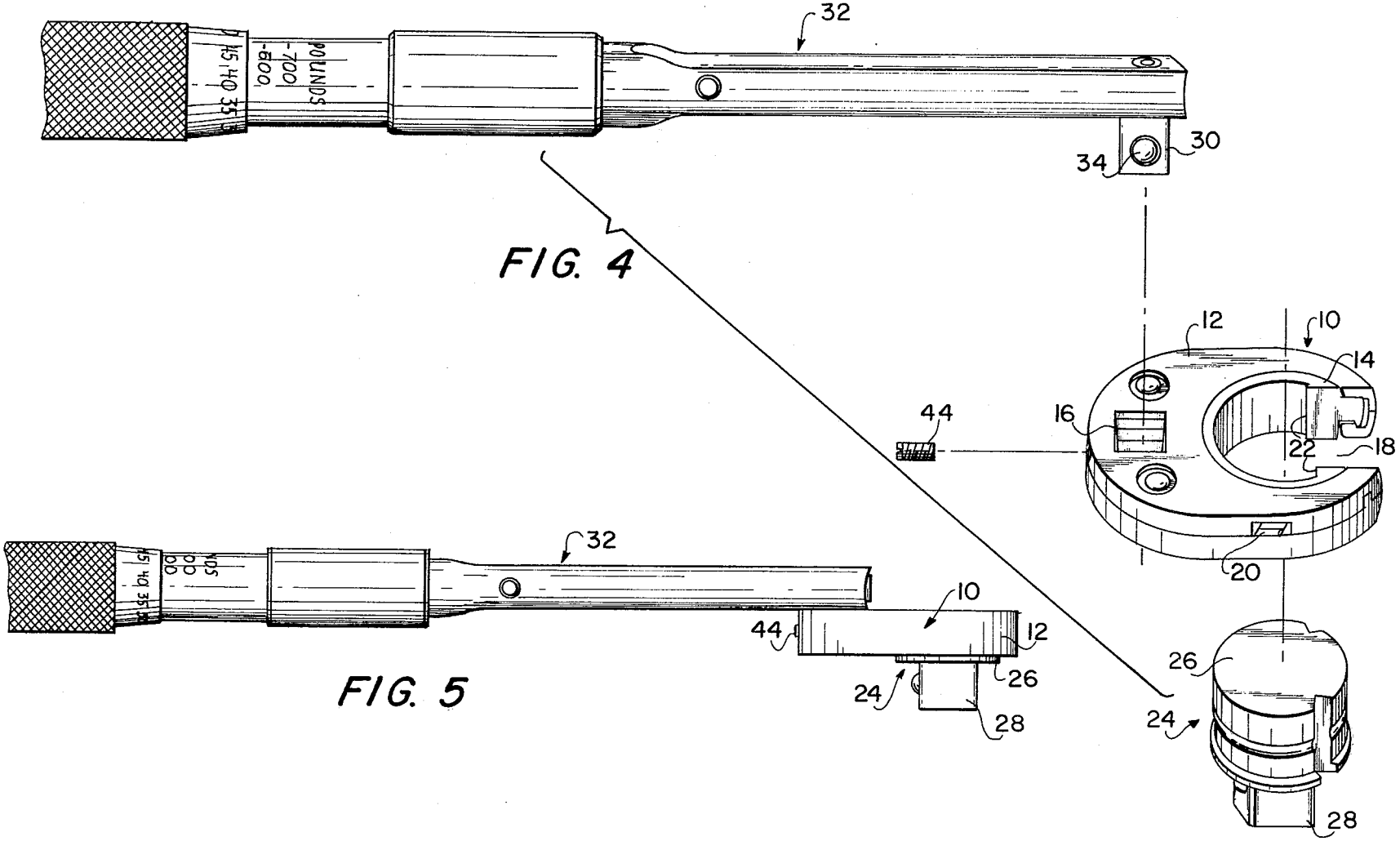
FIG. 4 is a view similar to FIG. 1 but illustrating the use of a different handle.
FIG. 5 is a side elevation view of the torque wrench assembly of FIG. 4 illustrating the parts in operative position.

Referring to the drawings, and initially to FIG. 1 thereof, reference number 10 designates a TAC pattern wrench head modified in accordance with the invention. The head comprises the usual body 12, of flat, elongated, somewhat oval shape, with an annular ratchet wheel 14 at one end and a square drive opening 10 at the other end. For purposes of illustration, the wrench head is shown as the open-end type having an opening 18 in the body and a corresponding opening in the ratchet wheel. The external ratchet wheel teeth which are hidden from view in FIG. 1 engage spring-biased pawls inside the head in the usual manner. A pawl release lever 20 may be provided in the usual manner. As is well known, the ratchet wheel 14 is open internally to receive an element to be driven. Although a wide variety of elements, such as hexagonal sockets, may be coupled to the ratchet wheel 14 and driven by the driving shoulders 22 in a well known manner, for puposes of illustration the driven element is shown as an adapter 24 having a cylindrical portion 26 which snaps into the ratchet wheel 14 and having a driving stud 28 for engaging conventional sockets. Since the wrench head is conventional, except for what will now be described, a detailed description of the wrench head is unnecessary. Such details may be found, for example, in the applicant's prior patents, such as U.S. Pat. No. 2,680,985, issued June 15, 1954.

In accordance with the invention, the usual square drive opening 16, which passes completely through the body, is enlarged to a size substantially greater than that normally employed for a given size wrench head. For example, a No. 500 TAC pattern wrench head normally having a ¼ inch square drive opening 16 is modified to provide a ⅜ inch square drive opening. Existing wrench heads of this type may be broached out to provide the enlarged opening, but newly manufactured wrench heads may incorporate the enlarged opening by minimal design modification.

As shown in FIG. 4, the enlarged drive opening 16 will then accommodate and fit the ⅜ inch square drive stud 30 of a micrometer type torque handle 32. A recess (not shown) may be provided inside the drive opening 16 to receive the spring-biased ball detent 34 of the drive stud for releasibly coupling the handle to the head in the usual manner. Enlargement of the drive opening 16 and the use of the larger handle 32 permits utiliziation of the maximum torque rating of the wrench head 10, which in the example given may be 1000 in.-lbs. To cover the lower portion of the torque range, it is necessary to permit the use of the same wrench head with a smaller micrometer type torque handle 36 having a square drive stud 38 fitting the original opening 16, drive stud 38 being a ¼ inch drive stud, for example. To accomplish this a square adapter sleeve 40 is employed, the adapter sleeve having outer cross-dimensions fitting the enlarged cross-dimensions of drive opening 16 and having an opening 42 with inner cross-dimensions fitting the drive stud 38 of handle 36, recess 43 receiving the detent 34 of that hand. Adapter sleeve 40 may be detachably held in opening 16 by means of a set screw 44 threaded into the end of body 12 and into the opening 16. See FIG. 3, which illustrates the same concept of the invention but applied to a closed-end wrench head 10'.

By this arrangement, the same wrench head 10 may be utilized in an assembly with handle 36 and adapter 40 to cover the torque range of say 5 to 150 in.-lbs. and with handle 32 alone (FIG. 4) to cover the torque range of 150 to 750 in.-lbs. Similarly, the maximum torque ratings of other sizes of TAC pattern wrench heads may be utilized by increasing the size of the drive opening and providing an appropriately dimensioned adapter sleeve in the same manner. For example, a wrench head previously having ⅜ inch square drive opening may be modified to provide a ½ inch drive opening for use with handles having ½ inch drive studs, an adapter sleeve being employed to reduce the drive opening to the original ⅜ inch size for use with handles having ⅜ inch drive studs. A head havin a ½ inch drive opening may be modified to provide an enlarged drive opening of ¾ inch for use with handles having a ¾ inch drive stud, an adapter sleeve being employed to reduce the enlarged opening to its original ½ inch size for use with handles having ½ inch drive studs. In each instance the full torque range capability of the wrench head may be utilized without in any way impairing the advantageous characteristics of the TAC pattern wrenches. Thus, as shown in FIG. 5, the exceptionally low, almost planar profile of the wrench is maintained, permitting utilization of the wrench in very tight quarters where torque wrenches other than the TAC pattern type can only be used with difficulty or not al all. Also, the drive stud may be inserted in either end of the drive opening or adapter sleeve to permit tightening or loosening rotation of the ratchet wheel.

While preferred forms of the invention have been shown and described, it will be apparent to those skilled in the art that changes can be made without departing from the principles and spirit of the invention, the scope of which is defined in the following claims.

I claim:

1. A torque wrench assembly comprising a ratchet head and a pair of torque wrench handles adapted to drive said head, said head including a substantially flat elongated body with a ratchet wheel rotatably mounted adjacent to one end of the body and with a square drive opening adjacent to the opposite end of the body, said ratchet wheel having means for engaging and turning a member to be driven, one of said handles having a square drive stud fitting said drive opening the other of said handles having a square drive stud substantially smaller than said drive opening, an adapter sleeve having outer cross-dimensions fitting said drive opening and having inner cross-dimensions fitting the drive stud of said other handle, the cross-dimensions of said drive opening being selected from the group consisting of about ⅜ inch, about ½ inch, and about ¾ inch, and the inner cross-dimensions of the corresponding adapter sleeve being selected, respectively, from the group consisting of about ¼ inch, about ⅜ inch, and about ½ inch, and means for detachably securing said adapter sleeve in said drive opening, the drive studs of said one handle and said other handle each having a detent and said body and said adapter sleeve each having a recess for receiving the detents of said drive studs, respectively, whereby said handles may be releasably coupled to said body and to said adapter sleeve, respectively, said drive opening extending comletely through said body so that said drive studs may be inserted into said drive opening and said adapter sleeve, respectively, from either end thereof, the torque range rating of said one handle being substantially higher than the torque range rating of said other handle, and the maximum torque rating of said ratchet head being substantially higher than the maximum torque rating of said other handle and at least as high as the maximum torque rating of said one handle, whereby said ratches head in conjunction with both said handles and said adapter sleeve can operate over a substantially increased torque range.

* * * * *